US010675513B1

(12) United States Patent
Venezio

(10) Patent No.: US 10,675,513 B1
(45) Date of Patent: Jun. 9, 2020

(54) GOLF CLUB WITH REDUCED AIR RESISTANCE CLUB HEAD

(71) Applicant: William Venezio, Schenectady, NY (US)

(72) Inventor: William Venezio, Schenectady, NY (US)

( * ) Notice: Subject to any disclaimer, the term of this patent is extended or adjusted under 35 U.S.C. 154(b) by 0 days.

(21) Appl. No.: 15/950,990

(22) Filed: Apr. 11, 2018

(51) Int. Cl.
*A63B 53/04* (2015.01)

(52) U.S. Cl.
CPC ..... *A63B 53/04* (2013.01); *A63B 53/047* (2013.01); *A63B 53/0466* (2013.01); *A63B 2225/01* (2013.01)

(58) Field of Classification Search
USPC ..... 473/324–350
See application file for complete search history.

(56) References Cited

U.S. PATENT DOCUMENTS 780,776 A * 1/1905 Brown ..... A63B 53/04 473/327
3,719,359 A * 3/1973 Evans ..... A63B 53/04 473/328
3,997,170 A * 12/1976 Goldberg ..... A63B 53/04 473/327
4,065,133 A * 12/1977 Gordos ..... A63B 53/04 473/327
4,213,613 A * 7/1980 Nygren ..... A63B 53/04 473/327
5,613,915 A * 3/1997 Van Alen, Jr. ..... A63B 69/3632 473/228
5,944,614 A * 8/1999 Yoon ..... A63B 53/04 473/224
D425,157 S * 5/2000 Reed ..... D21/744
6,969,325 B1 * 11/2005 Harrelson ..... A63B 53/047 473/327
7,121,966 B2 * 10/2006 Fitzmaurice ..... A63B 59/00 473/559
7,641,568 B2 * 1/2010 Hoffman ..... A63B 53/0466 473/327
8,845,453 B1 * 9/2014 Ehlers ..... A63B 53/0466 473/327
2004/0152537 A1 * 8/2004 Moore, Jr. ..... A63B 53/047 473/328

(Continued)

FOREIGN PATENT DOCUMENTS

JP 09075486 A * 3/1997
JP 2001314536 A * 11/2001
JP 2008194116 A * 8/2008

*Primary Examiner* — Alvin A Hunter
(74) *Attorney, Agent, or Firm* — Oltman, Flynn & Kubler

(57) ABSTRACT

A golf club includes a club handle, a club head including a series of spaced apart club head segments having segment forward faces collectively forming a club head forward face for striking a ball and being separated by substantially parallel club head slots oriented relative to the club handle to be substantially parallel to the direction of club swing so that air passes directly into and through the club head slots as a user swings the club, permitting the user to swing the club with greater speed and therefore to strike a ball with greater force, and a spine structure interconnecting the club head segments. The spine structure preferably extends transversely relative to the club head segment. The cross-sectional shape of the spine structure preferably is generally elongate in the direction of a club swing.

8 Claims, 4 Drawing Sheets

(56) References Cited

U.S. PATENT DOCUMENTS

| | | | | |
|---|---|---|---|---|
| 2005/0032584 | A1* | 2/2005 | Van Nimwegen | A63B 53/0466 473/327 |
| 2005/0064953 | A1* | 3/2005 | Moore, Jr. | A63B 53/047 473/327 |
| 2006/0100027 | A1* | 5/2006 | Wang | A63B 53/047 473/327 |
| 2007/0142120 | A1* | 6/2007 | Krewalk | A63B 53/04 473/328 |

* cited by examiner 10
20
42S
42ES
42E
44
40
42
40F
60
42P

GOLF CLUB WITH REDUCED AIR RESISTANCE CLUB HEAD

BACKGROUND OF THE INVENTION

1. Field of the Invention

The present invention relates generally to the field of golf equipment. More specifically the present invention relates to a golf club having a club handle and a club head, the club head including a series of spaced apart club head segments interconnected by a spine structure. The club head segments are separated by parallel club head slots and have segment forward faces collectively forming a club head forward face for striking a ball. The slots are oriented relative to the club handle to be parallel to the direction of swing. Air directly enters and passes straight through the slots as the user swings the club rather than being deflected around the head, reducing air resistance. The spine structure extends transversely relative to the head segments, either through the middle or along the back of the club head. The overall shape of the club head, and the cross-sectional shape of the spine structure, are such that they minimize the resistance of air passing over them. The head segments at each lateral end of the head segment series have curved, contoured outward surfaces so that the ends of the club head are aerodynamic. The result is that the golfer is able to swing the club with greater speed and therefore to strike the ball with greater force.

The cross-sectional shape of the spine structure is generally elongate in the direction of swing and substantially elliptical, much like an airplane wing. The spine structure cross-section preferably has pointed leading and trailing edges. The spine structure passes through the approximate center of each of the head segments. The club handle meets the club head in a conventional way, so that the club head is readily positioned to be perpendicular to the direction of swing.

2. Description of the Prior Art

There have long been golf clubs with heads shaped to improve the speed and accuracy of the swing. Most have presented impenetrable solid profiles which must rapidly displace air along their path to the ball.

A few prior club heads have included slots, although these slots are limited and primarily designed to pass grass, sand and water. As a result, these prior slots or notches are generally located along the lower portion or lower edge of the club head only. It appears that only one known reference, Moore, Jr., mentions slots that may provide an additional benefit of reducing resistance to the same extent.

Moore, Jr., U.S. Patent Application Publication Number 2004/0152537, published on Aug. 5, 2004, discloses a golf club designed to minimize ground resistance. As noted above, the Moore, Jr. club head has slots for passing sand and grass as the head contacts the ground during a swing, and it is noted that these slots may also reduce air resistance to some extent. The Moore, Jr. slots are in the lower portion of the club head only, rather than extending through the full height of the club head. Thus, a problem with Moore, Jr. is that the solid upper portion of the club head apparently produces as much air resistance as the upper portion of any conventional club head, and any reduced air resistance is minimal and purely incidental.

Otoguro, U.S. Pat. No. 6,517,449, issued on Feb. 11, 2003, discloses the structure of a head of a golf club iron.

Otoguro discloses a series of small notches along the club head lower edge, similar to the slots of Moore, Jr., but less pronounced. As a result, any difference in air resistance between Otoguro and a conventional golf club head is likely to be either minimal or nonexistent.

Asplund, et al., U.S. Pat. No. 6,846,246, issued on Jan. 25, 2005, teaches a slotted golf club head for reducing resistance caused by sand, water or grass when striking a ball. The club head has "a slotted lower portion having a plurality of slots for allowing an obstacle such as sand to pass through the golf club head" and an "un-slotted upper portion", and is therefore similar to Moore, Jr. The striking surface is sharply angled and a cavity is provided in the rear surface.

Bellfuss, Sr., U.S. Pat. No. 5,000,455, issued on Mar. 19, 1991, teaches a sand and water wedge for golf. Bellfuss, Sr., provides a golf club head having narrow grooves extending perpendicularly across slots which are intended to minimize drag caused by said and water during a swing. While Bellfuss, Sr., is intended to provide this benefit, the wedge shape and the minimal width of the openings produced by the intersecting grooves and slots seem insufficient to produce more than a negligible reduction in air resistance, and Bellfuss, Sr., apparently is not designed for that purpose.

Finally, Gallagher, U.S. Pat. No. 6,042,486, issued on Mar. 28, 2000, reveals a golf club head with a filled damping slot and an opening to a central cavity behind a floating club face. The striking face has a face aperture from front to back which is filled with a material intended to dampen the transmission of shock and vibration into the handle. No air passing slot appears to be provided.

It is thus an object of the present invention to provide a golf club with a club head including a series of spaced apart club head sections separated by slots oriented to pass a maximum amount of air as the club swings, and thus to minimize air resistance.

It is another object of the present invention to provide such a club head which is lighter in weight than a conventional club head, as a result of the substitution of slots for portions of the club head.

It is still another object of the present invention to provide such a club head which is sturdy and solid.

It is finally an object of the present invention to provide such a club head which is relatively inexpensive to manufacture.

SUMMARY OF THE INVENTION

The present invention accomplishes the above-stated objectives, as well as others, as may be determined by a fair reading and interpretation of the entire specification.

A golf club is provided, including a club handle; a club head including a series of spaced apart club head segments having segment forward faces collectively forming a club head forward face for striking a ball and being separated by substantially parallel club head slots oriented relative to the club handle to be substantially parallel to the direction of club swing so that air passes directly into and through the club head slots as a user swings the club, permitting the user to swing the club with greater speed and therefore to strike a ball with greater force, and a spine structure interconnecting the club head segments.

The spine structure preferably extends transversely relative to the club head segments. The overall shape of the club head, and the cross-sectional shape of the spine structure preferably are selected so that they minimize the resistance of air passing over them. The club head segments at each lateral end of the series of the club head segments preferably have contoured outward surfaces so that opposing ends of the club head are aerodynamic. The cross-sectional shape of the spine structure preferably is generally elongate in the direction of a club swing. The cross-sectional shape of the spine structure optionally is substantially elliptical. The spine structure cross-section optionally has a sharp spine structure leading edge and a sharp spine structure trailing edge. The spine structure preferably intersects the approximate center of each of the club head segments.

The widths of the individual head segments between the club head segments at opposing ends of the club head preferably are substantially uniform. The widths of the club head slots preferably are substantially uniform. The widths of the club head slots preferably are substantially uniform and substantially match the widths of the club head segments.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figures 1, 2, 3:
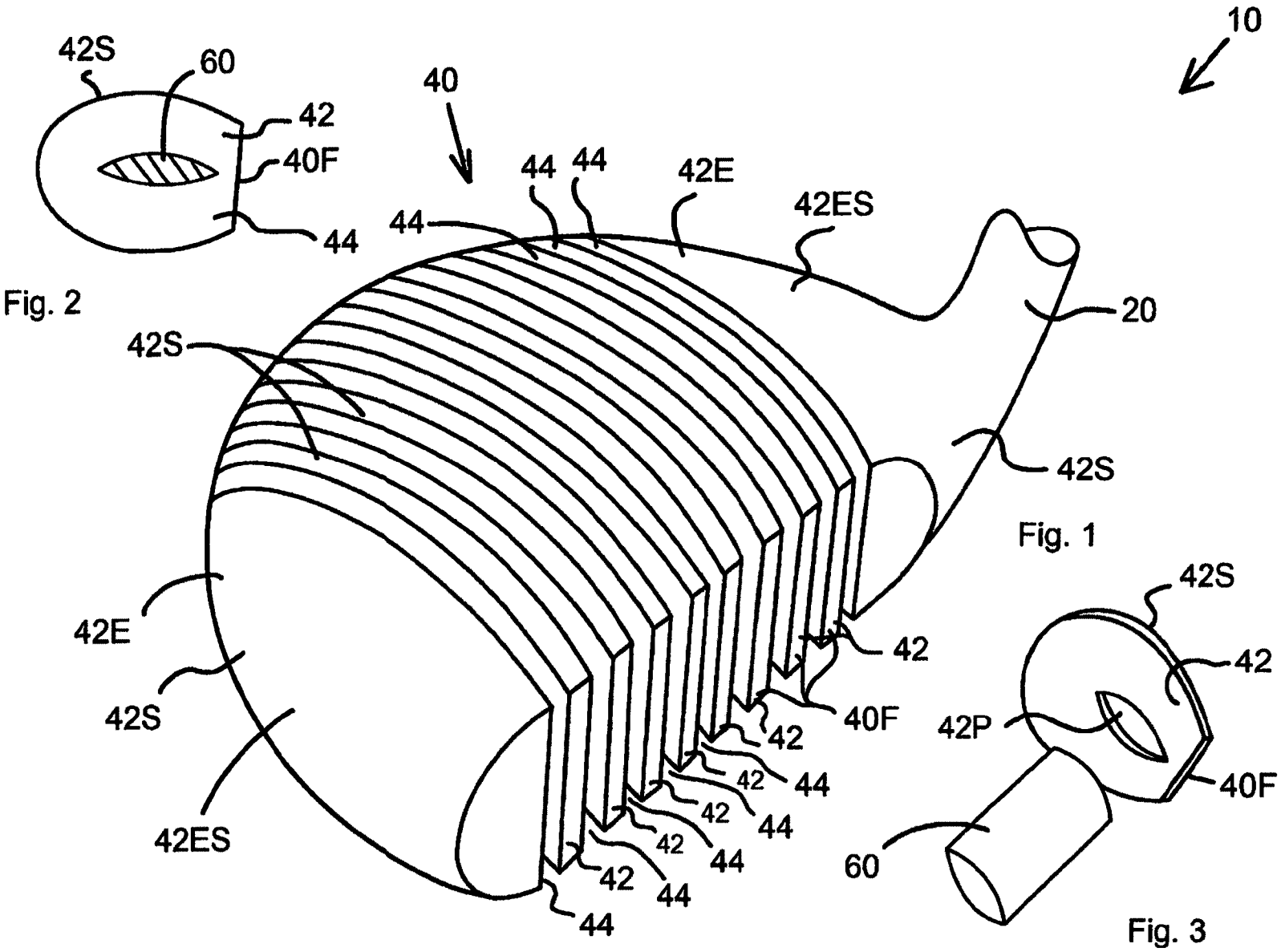
FIG. 1 is a perspective view of the preferred embodiment of the present golf club with the upper portion of the handle omitted, where the golf club is in this instance a wood.
FIG. 2 is a cross-sectional view of the club head of FIG. 1, showing the profile of the spine structure of the preferred embodiment.
FIG. 3 is a perspective view of a spine structure and a club head segment having a central port sized and aligned to receive the spine structure for an assembled version of the club head in which separate pieces are glued together, as distinguished from the version that is molded or cut from a single piece of material.
Figure 4:
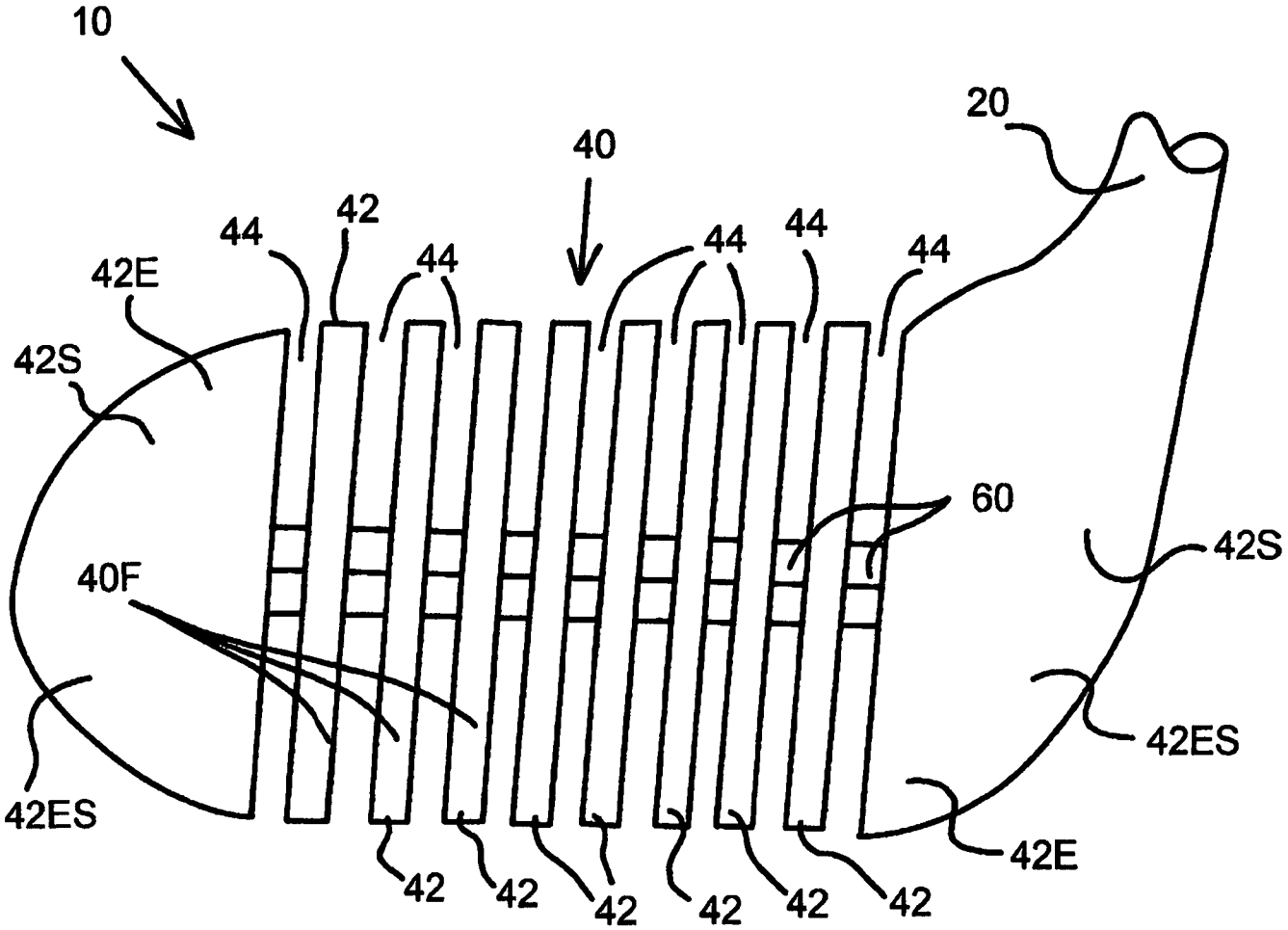
FIG. 4 is a front plan view of the club head of FIG. 1.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

The Invention Generally Referring to FIGS. 1-7, a golf club 10 is disclosed having a club handle 20 and a club head 40, the club head 40 including a series of spaced apart club head segments 42 interconnected by a spine structure 60. The club head segments 42 have segment forward faces 42F and are separated by parallel club head slots 44. The club head slots 44 are oriented relative to the club handle 20 and club face 42F to be parallel to the direction of swing. As a result, air directly enters and passes through the club head slots 44 as the user swings the club 10 rather than being deflected around the head 40, thereby reducing air resistance. The segment forward faces 42F collectively form a club head forward face 40F for striking a ball (not shown). The spine structure 60 extends transversely relative to the head segments 42, either through the middle or along the back of the club head 40. The overall shape of the club head 40, and the cross-sectional shape of the spine structure 60 are such that they minimize the resistance of air passing over them. This includes the head segments 42 at each lateral end of the head segment 42 series which preferably have curved, contoured outward surfaces 42S so that the ends of the club head 40 are aerodynamic. The result is that the golfer is able to swing the club 10 with greater speed and therefore to strike the ball with greater force.

The Preferred Embodiment

Figure 5:
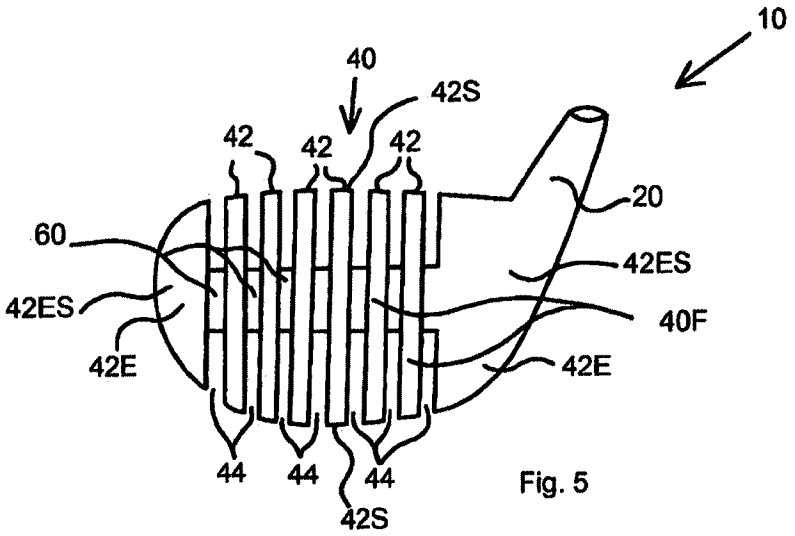
FIG. 5 is a perspective view of the preferred embodiment, where club is an iron, and once again the upper portion of the handle omitted.
Figure 6:
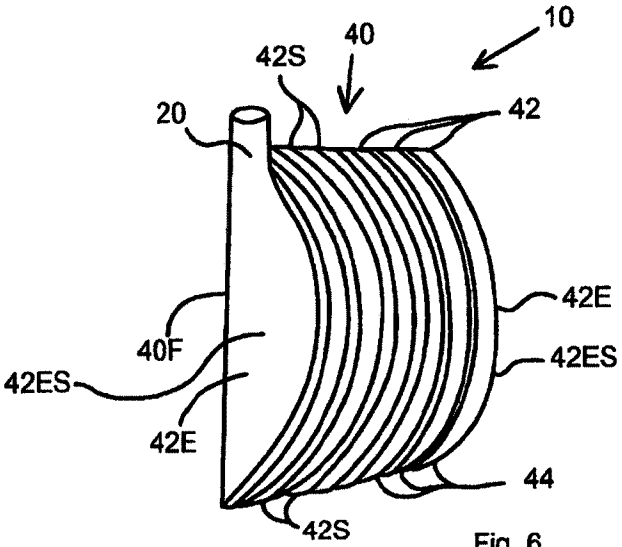
FIG. 6 is a front plan view of the club head of FIG. 5.
Figure 7:
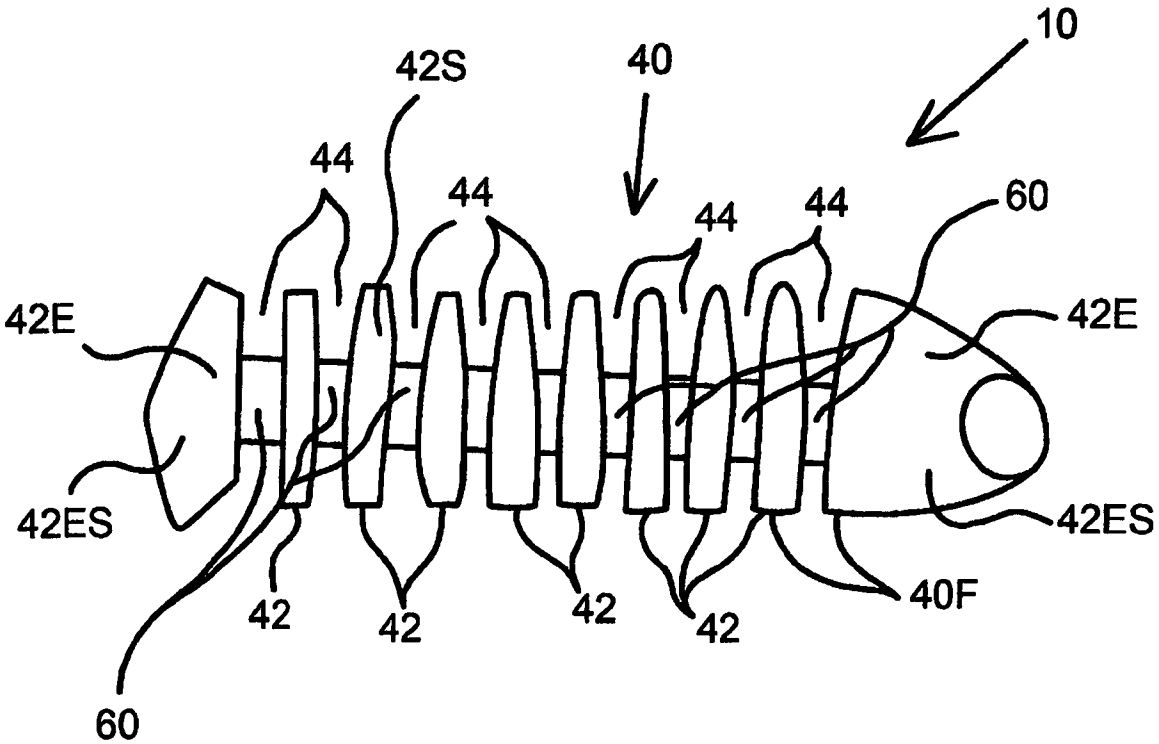
FIG. 7 is a bottom plan view of the club head of FIG. 5.

The cross-sectional shape of the spine structure is generally elongate in the direction of swing and substantially elliptical, much like an airplane wing. The spine structure cross-section preferably has pointed leading and trailing edges. The spine structure passes through the approximate center of each of the head segments. The club head segments 42 optionally each have a central port 42P sized and aligned to receive the spine structure 60 for a version in which the club head 40 is assembled from separate pieces which are glued or otherwise fastened together, as shown in FIG. 3. Alternatively either the club head 40 or the entire golf club 10 is molded or cut from a single piece of material. FIGS. 1-4 illustrate the inventive club head 40 in the form of a wood, and FIGS. 5-7 illustrate the club head 40 in the form of an iron.

The club handle 20 meets the club head 40 in a conventional way, so that the club head can be positioned to be perpendicular to the direction of swing.

The widths of the individual club head segments 42 between the end head segments 42E preferably are substantially uniform. The widths of the club head slots 44 preferably are substantially uniform. Finally, the widths of the club head slots 44 preferably are substantially uniform and preferably substantially match the widths of the head segments 42.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A golf club, comprising:

a club handle;

a club head comprising a series of spaced apart club head segments having segment forward faces collectively forming a club head forward face for striking a ball and being separated by substantially parallel club head slots oriented relative to said club handle to be substantially parallel to the direction of club swing such that air passes directly into and through the club head slots as a user swings the club, permitting the user to swing the club with greater speed and therefore to strike a ball with greater force, and a spine structure interconnecting said club head segments, said spine structure extending transversely relative to said club head segments and having a cross-sectional shape which is generally elongate in the direction of a club swing and substantially elliptical.

2. The golf club of claim 1, wherein the overall shape of said club head, and the cross-sectional shape of said spine structure, are selected such that they minimize the resistance of air passing over them.

3. The golf club of claim 1, wherein said club head segments at each lateral end of the series of said club head segments have contoured outward surfaces such that opposing ends of said club head are aerodynamic.

4. The golf club of claim 1, wherein said spine structure cross-section has a sharp spine structure leading edge and a sharp spine structure trailing edge.

5. The golf club of claim 1, wherein said spine structure intersects the approximate center of each of said club head segments.

6. The golf club of claim 1, wherein the widths of the individual head segments between said club head segments at opposing ends of said club head are substantially uniform.

7. The golf club of claim 1, wherein the widths of the club head slots are substantially uniform.

8. The golf club of claim 1, wherein the widths of the club head slots are substantially match the widths of said club head segments.

* * * * *